US011846169B2

(12) United States Patent
Wagner et al.

(10) Patent No.: US 11,846,169 B2
(45) Date of Patent: Dec. 19, 2023

(54) INTEGRATED PUMP AND MANIFOLD ASSEMBLY

(71) Applicant: SPM Oil & Gas Inc., Fort Worth, TX (US)

(72) Inventors: Bryan C. Wagner, Fort Worth, TX (US); Richard David Peer, Fort Worth, TX (US); Wesley P. Clark, Weatherford, TX (US)

(73) Assignee: SPM Oil & Gas Inc., Fort Worth, TX (US)

( * ) Notice: Subject to any disclaimer, the term of this patent is extended or adjusted under 35 U.S.C. 154(b) by 128 days.

(21) Appl. No.: 17/600,565

(22) PCT Filed: Jul. 22, 2020

(86) PCT No.: PCT/US2020/043002

§ 371 (c)(1),
(2) Date: Sep. 30, 2021

(87) PCT Pub. No.: WO2021/016312

PCT Pub. Date: Jan. 28, 2021

(65) Prior Publication Data

US 2022/0213776 A1 Jul. 7, 2022

Related U.S. Application Data

(60) Provisional application No. 62/877,492, filed on Jul. 23, 2019.

(51) Int. Cl.
*E21B 43/26* (2006.01)

(52) U.S. Cl.
CPC ..... *E21B 43/2607* (2020.05)

(58) Field of Classification Search
CPC ..... E21B 43/2607; E21B 43/26
See application file for complete search history.

(56) References Cited

U.S. PATENT DOCUMENTS

| | | | | |
|---|---|---|---|---|
| 2011/0266390 | A1 | 11/2011 | Nakagawa et al. | |
| 2014/0086769 | A1 | 3/2014 | Barnett, Jr. | |
| 2015/0000766 | A1 | 1/2015 | Arizpe et al. | |
| 2015/0192117 | A1* | 7/2015 | Bridges | F04B 23/06 417/364 |
| 2016/0208592 | A1 | 7/2016 | Oehring | |

(Continued)

OTHER PUBLICATIONS

International Search Report and Written Opinion on PCT PCT/US2020/043002 dated Oct. 6, 2020.

*Primary Examiner* — Kipp C Wallace
(74) *Attorney, Agent, or Firm* — Foley & Lardner LLP

(57) ABSTRACT

An integrated pump and manifold assembly includes a support structure, a manifold assembly mounted on the support structure, and one or more frac pumps. The manifold assembly includes one or more low pressure lines and a high pressure discharge line including a discharge outlet configured to fluidly couple to a wellhead. The one or more frac pumps are each mounted on the support structure and include a frac pump inlet and a frac pump outlet. The one or more frac pumps are configured to be in fluid communication with the one or more low pressure lines and the high pressure discharge line. The one or more low pressure lines, the high pressure discharge line, and the one or more frac pumps are integrated as a single unit and mounted on the support structure.

19 Claims, 12 Drawing Sheets

(56) References Cited

U.S. PATENT DOCUMENTS

| | | | | |
|---|---|---|---|---|
| 2016/0319650 | A1* | 11/2016 | Oehring | F04B 17/03 |
| 2019/0009232 | A1 | 1/2019 | Yeung | |
| 2019/0071951 | A1* | 3/2019 | Spencer | E21B 43/2607 |
| 2019/0178234 | A1* | 6/2019 | Beisel | F04B 11/0041 |
| 2019/0331100 | A1* | 10/2019 | Gable | F04B 11/005 |
| 2020/0182236 | A1* | 6/2020 | Beisel | F04B 1/053 |
| 2020/0291731 | A1* | 9/2020 | Haiderer | E21B 43/2607 |
| 2020/0400003 | A1* | 12/2020 | Webster | E21B 33/068 |
| 2021/0388705 | A1* | 12/2021 | Stephenson | E21B 43/2607 |

* cited by examiner

INTEGRATED PUMP AND MANIFOLD ASSEMBLY

CROSS-REFERENCE TO RELATED PATENT APPLICATIONS

This application is filed under 35 U.S.C. 371, and claims the benefit of and priority to PCT/US2020/043002, having a filing date of Jul. 22, 2020, entitled "INTEGRATED PUMP AND MANIFOLD ASSEMBLY," which claims the benefit of and priority to U.S. Provisional Patent Application No. 62/877,492, having a filing date of Jul. 23, 2019, entitled "INTEGRATED PUMP AND MANIFOLD SKID, both of which are incorporated herein by reference in their entirety for all purposes.

TECHNICAL FIELD

This disclosure relates to manifold assemblies and pump units used in hydraulic fracturing.

BACKGROUND

Conventionally, a manifold assembly may be used to convey pressurized fluids to hydraulically fracture (or "frac") a subterranean formation using pressurized fluid in a wellbore or wellhead, thereby facilitating oil and gas exploration and production operations. A conventional manifold assembly includes a high pressure manifold and a low pressure manifold each including one or more flow lines through which fluid flows in and out of pumps acting to pressurize the fluid. For a single frac site, multiple pump units and manifold assemblies are separately transported to the site on various trailers. For example, on a typical site, more than 20 trailers may be used to transport in the pump units alone, with several additional trailers being used to transport in the manifold assemblies. The pump units and manifold assemblies must be coupled together using frac iron or piping at the frac site, prior to being used as part of the frac job. In addition, typically the pump units are powered using diesel engines.

SUMMARY

One embodiment relates to an integrated pump and manifold assembly that includes a support structure, a manifold assembly mounted on the support structure, and one or more frac pumps. The manifold assembly includes one or more low pressure lines and a high pressure discharge line including a discharge outlet configured to fluidly couple to a wellhead. The one or more frac pumps are each mounted on the support structure and include a frac pump inlet and a frac pump outlet. The one or more frac pumps are configured to be in fluid communication with the one or more low pressure lines and to receive a low pressure fluid from the one or more low pressure lines through the frac pump inlet of each of the one or more frac pumps. The one or more frac pumps are configured to be in fluid communication with the high pressure discharge line and to output a high pressure fluid to the high pressure discharge line through the frac pump outlet of each of the one or more frac pumps. The one or more low pressure lines, the high pressure discharge line, and the one or more frac pumps are integrated as a single unit and mounted on the support structure.

Another embodiment relates to a method of assembling an integrated pump and manifold assembly. The method comprises providing a support structure, mounting a manifold assembly on the support structure, and mounting one or more frac pumps on the support structure. The manifold assembly comprises one or more low pressure lines and a high pressure discharge line comprising a discharge outlet configured to fluidly couple to a wellhead. The one or more frac pumps each comprise a frac pump inlet and a frac pump outlet. The one or more low pressure lines, the high pressure discharge line, and the one or more frac pumps are integrated as a single unit and mounted on the support structure.

These and other features, together with the organization and manner of operation thereof, will become apparent from the following detailed description when taken in conjunction with the accompanying drawings, wherein like elements have like numerals throughout the several drawings described below.

DETAILED DESCRIPTION

Figure 1A:
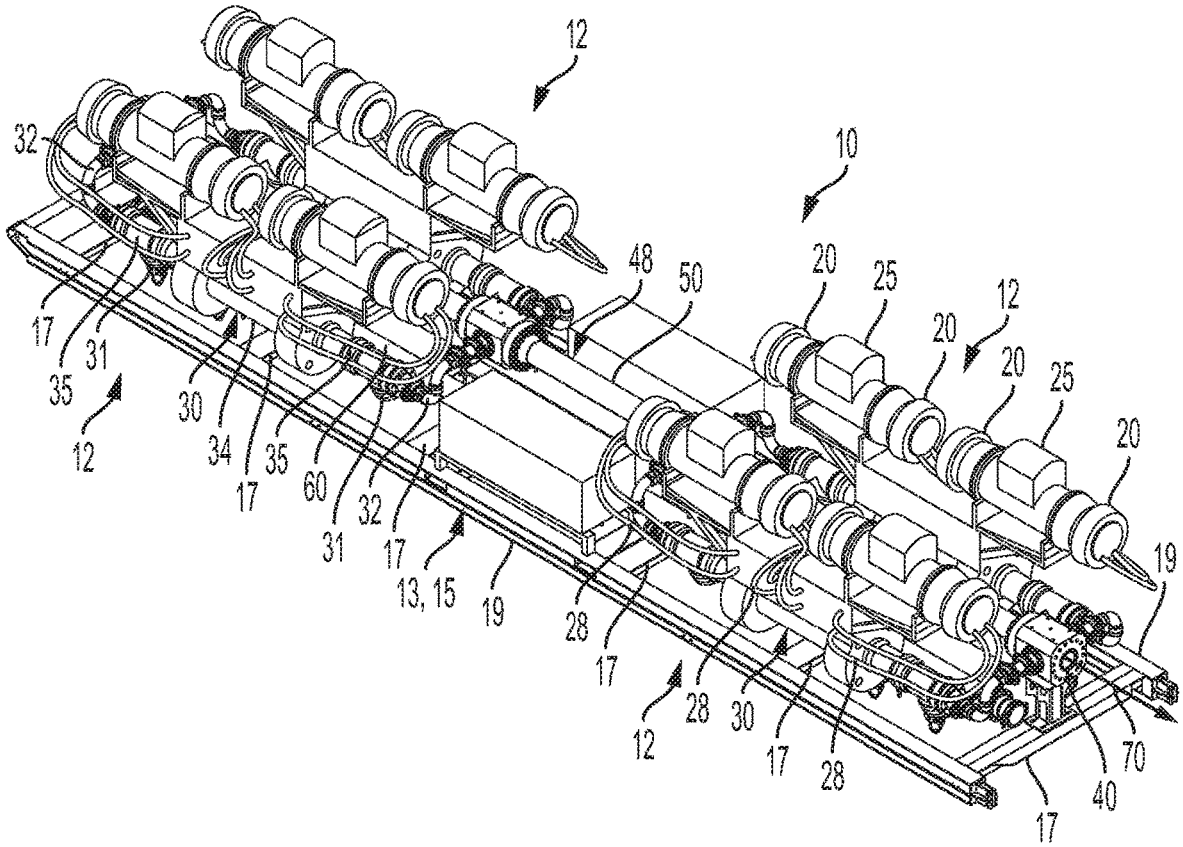
FIG. 1A shows a perspective view of an integrated pump and manifold assembly according to one embodiment.

Referring to the figures generally, an integrated pump and manifold assembly is shown, according to various exemplary embodiments. In the integrated pump and manifold assembly, the frac pump and the manifold (and optionally also the hydraulic power unit or pump and/or the power source for the pump unit) are integrated together and mounted on the same, common support structure (e.g., a skid or trailer). As described further herein, the integrated pump and manifold assembly has many advantages over the conventional arrangement of a separate pump unit and manifold.

Conventional separate pump units and manifolds are separately transported to the fracturing (or "frac") site and subsequently attached together at the frac site to allow fluid to flow therebetween. For example, in a typical frac spread, separate frac pump units and discharge manifolds are separated by iron that is rigged up upon arrival on location at the frac site. Each of these units is driven to the location separately and then must be strategically placed on location at the frac site to allow the pump units and the manifold to be fluidly attached to each other at the frac site. This increases both the required labor and rig-up time, the required number of components and parts (including hoses and flow iron), and the required amount of room at the frac site. Additionally, this particular setup may contribute to the majority of flow iron failures during a frac job and requires a significant amount of piping between the pump truck (with the pump units) and the separate manifold skid.

Comparatively, the integrated pump and manifold assembly described herein incorporates and combines pump units (in particular the frac pump(s)) with a manifold assembly, all of which is mounted on a single support structure (e.g., a skid or a trailer). According to some embodiments, instead of separately transporting the pump units and the manifold assemblies, the pump units and manifold assemblies are integrated together on the support structure and transported to the frac site together in an assembled manner, as one unit. Since the integrated pump and manifold assembly is delivered to the frac site already assembled as a single unit, the rig-up time for the iron between the pumps and the manifold at the frac site is eliminated, thereby improving the efficiency. Furthermore, the number of required components (including hoses and flow iron) and the required footprint at the frac site is decreased.

To enable the integrated nature of the pump and manifold assembly, natural gas that is available at the frac site in each of the basins where the fracturing work is occurring can be reclaimed and used to generate electrical power using gas turbine generators at or near a frac location, which powers the pump and manifold assembly with electricity. Conventionally, this natural gas is commonly directed to a flare, where it is flamed to the atmosphere and wasted. However, by reclaiming the natural gas, the resulting generated electrical power can be used in various ways at the frac site, one of which is to power electric motors of the disclosed integrated pump and manifold assembly to drive and power corresponding actuators (e.g., the hydraulic units or pumps) of the integrated pump and manifold assembly used in the frac pump drive system. Since the pump and manifold assembly is not limited by the maximum power a diesel engine could provide for a mobile frac unit, the pump units within the pump and manifold assembly may be larger, thereby reducing the number of pump units required at the frac location.

Additionally, conventionally, diesel engines are used in the fracturing process to drive the frac pumps. However, the integrated pump and manifold assembly described herein may use electric motors (instead of diesel engines), which provide meaningful space savings at the frac site. The pump units of the integrated pump and manifold assembly described herein can generate up to approximately 8,000-12,000 hydraulic horsepower per unit and discharge pressures of up to approximately 15,000 pounds per square inch (psi) using the electric motors. To create the same amount of horsepower and resulting pressures using diesel engines instead, the diesel engines would have to be significantly larger in size and weight.

The integrated pump and manifold assembly increases and improves the overall operational efficiency of the frac operation by reducing the number of parts and the overall footprint. Accordingly, the reliability of the integrated pump and manifold assembly is increased, while the cost and the required set-up time and labor is decreased. In particular, because of its integrated nature, the number of pieces of equipment used with the integrated pump and manifold assembly is reduced as compared to conventional frac operations, which reduces the rig-up time. This reduction in pieces of equipment also reduces the number of personnel and trailers that are necessary to transport the equipment to the frac site and assemble together at the frac site. For example, in the typical frac operation, more than 20 trailers are used to transport in the pump units alone. By using the integrated pump and manifold assembly described herein, the number of required trailers may be reduced to only a few. In addition to efficiency and costs savings due to the reduction of personnel, parts, and trailers and the amount of transportation required, fewer pieces of equipment also results in a smaller space or footprint requirement at the frac site, which in turn could result in smaller frac sites and less site preparation, thereby further reducing the total cost of ownership (in addition to the various other features, such as reduced maintenance and reduced rig-up time). Reducing the footprint and set-up time at the frac site is particularly important due to the limited space at the frac site and the complexity of the fracking equipment.

In addition, because the electrical power can be used to drive various types of pumps, the pump units may include linear frac pumps (or intensifiers) instead of reciprocating frac pumps at the frac site. Due to the shape and size of the linear pumps (for example, the linear pumps are longer and narrower than reciprocating pumps), the linear pumps can be mounted on opposite sides of the high pressure manifold (which includes the high pressure discharge line) and fit within the same or smaller footprint as the separate conventional manifold on a single skid. Therefore, the overall footprint of the integrated pump and manifold assembly is much smaller than conventional separate pumps and manifolds that are mounted on different skids and rigged or coupled together using frac iron once at the site. For example, the integrated pump and manifold assembly may reduce the footprint by approximately 50% compared to the conventional separate pumps and manifolds, which further improves the operational efficiency.

Furthermore, by using an electric engine (rather than a diesel engine) and thus reducing the overall footprint, the entire integrated pump and manifold assembly is small enough to be compliant with road regulations and can be legally driven along a road by a vehicle. For example, the entire width of the pump and manifold assembly (that may include a support structure that is a trailer) may be approximately 8-8.5 feet, which would fit within the maximum legal width limit of vehicles of approximately 8.5 feet.

The integrated pump and manifold assembly is also modular in design allowing for customization of the number of pump units and/or rearrangement of the pump units on location to match the specific job requirements. As such, the multiple pump units may be arranged side-by-side (e.g., substantially parallel) and/or end-to-end (e.g., in series with each other) to facilitate placement in the frac spread. Additionally, the modular design provides redundancy of parts, which increases the reliability of the pump and manifold assembly.

The integrated pump and manifold assembly described herein also increases the safety for personnel and operators working at the frac site and decreases the amount of time to set up the pump assembly. For example, the integrated pump and manifold assembly significantly reduces or eliminates the rig-up iron required and thereby reduces or eliminates the amount of moving tools, swinging hammers, and hazards related to the rigging of frac iron at the frac site.

The integrated pump and manifold assembly also reduces the amount of pressurized iron on location and reduces the number of joints or potential leak points. The joints each include sealing connections that may leak and contribute to the overall environmental emissions at the frac site such that reducing the number of joints used reduces the number of sealing connections required and also mitigates the environmental impact at the site. The joints may also pose a risk of failure and reducing the number of potential failure locations by reducing the number of joints is advantageous.

Referring to FIGS. 1A-1D, an integrated pump and manifold assembly 10 is shown, according to an exemplary embodiment. The integrated pump and manifold assembly 10 includes a support structure 13, one or more pump units 12, and a manifold assembly 48. At least a portion of (or all of) each of the pump units 12 and the manifold assembly 48 (in particular, a high pressure discharge line 50 and a low pressure line(s) 60 of the manifold assembly 48) are all mounted on the same, common support structure 13. However, as described further herein and according to various other embodiments (as shown, for example, in FIGS. 6A-8), an actuator 20 and/or the electric motor 25 of the pump unit 12 may be positioned separate from a frac pump 30 of the pump unit 12 and the manifold assembly 48. The one or more pump units 12 (in particular the frac pump 30), the high pressure discharge line 50, and the one or more low pressure lines 60 are integrated into a single unit and mounted on the support structure 13. The integrated pump and manifold assembly 10 also includes a control system (not shown) to control the operation of the components thereof.

The manifold assembly 48 comprises a suction or low pressure manifold (that comprises one or more low pressure lines 60) and a discharge high pressure manifold (that comprises a high pressure discharge line 50). The low pressure lines 60 are fluidly connected and coupled to and configured to direct low pressure fluid into the fluid end inlet 31 of the frac pump 30 of the pump unit 12. The high pressure line 50 is fluidly connected and coupled to and configured to receive high pressure fluid from the fluid end outlet (specifically from the fluid end discharge line 32) of the frac pump 30 of the pump unit 12. Accordingly, the high pressure line 50 is downstream from the low pressure line 60 (and the frac pump 30). The low pressure line(s) 60 and the high pressure line 50 may all extend substantially parallel to each other and extend longitudinally along the length of the support structure 13. Referring to FIGS. 1B-1C, the manifold assembly 48 may include the two low pressure lines 60 positioned on opposite sides of the high pressure discharge line 50.

The high pressure discharge line 50 comprises a high pressure discharge outlet 40 that allows fluid to be discharged from the entire pump and manifold assembly 10. In particular, the high pressure discharge line 50 discharges the high pressurized fluid 70 from the frac pump 30 to the wellhead 80 (or to another pump and manifold assembly 10) through the high pressure discharge outlet 40, as shown in FIG. 1A and FIGS. 1D-3. The high pressurize fluid 70 is discharged along a discharge axis 55.

As shown in FIG. 1B, the high pressure discharge line 50 is positioned along and extends parallel to a discharge axis 55. The discharge axis 55 extends longitudinally along the length of the support structure 13. According to one embodiment, two of the pump units 12 and one of the low pressure lines 60 are positioned on one side of the high pressure discharge line 50 (e.g., on one side of discharge axis 55), and the other two the pump units 12 and a second low pressure line 60 are positioned on an opposite side of the high pressure discharge line 50 (e.g., opposite side of the discharge axis 55).

Each of the low pressure lines 60, the frac pump 30 of each of the pump units 12, and the high pressure discharge line 50 are all in fluid communication with each other. In particular, fluid flows from the low pressure lines 60, through the pump units 12, and into the high pressure line 50 (to be discharged from the pump and manifold assembly 10 (through the high pressure discharge outlet 40) to the wellhead 80). As such, the frac pump 30 of each of the pump units 12 is in fluid communication with each of the low pressure lines 60 and the high pressure discharge line 50.

The support structure 13 is configured to hold and support the rest of the pump and manifold assembly 10 such that the entire pump and manifold assembly 10 can be easily transported (on, for example, a vehicle) as a single, attached and integrated unit. The entire pump and manifold assembly 10 (including the support structure 13, the manifold assembly 48, and the pump units 12) is transportable and movable together as a single unit. The support structure 13 provides a single surface or area to for the manifold assembly 48 and the pump units 12 to attach and mount to (for transportation together).

Figure 1B:
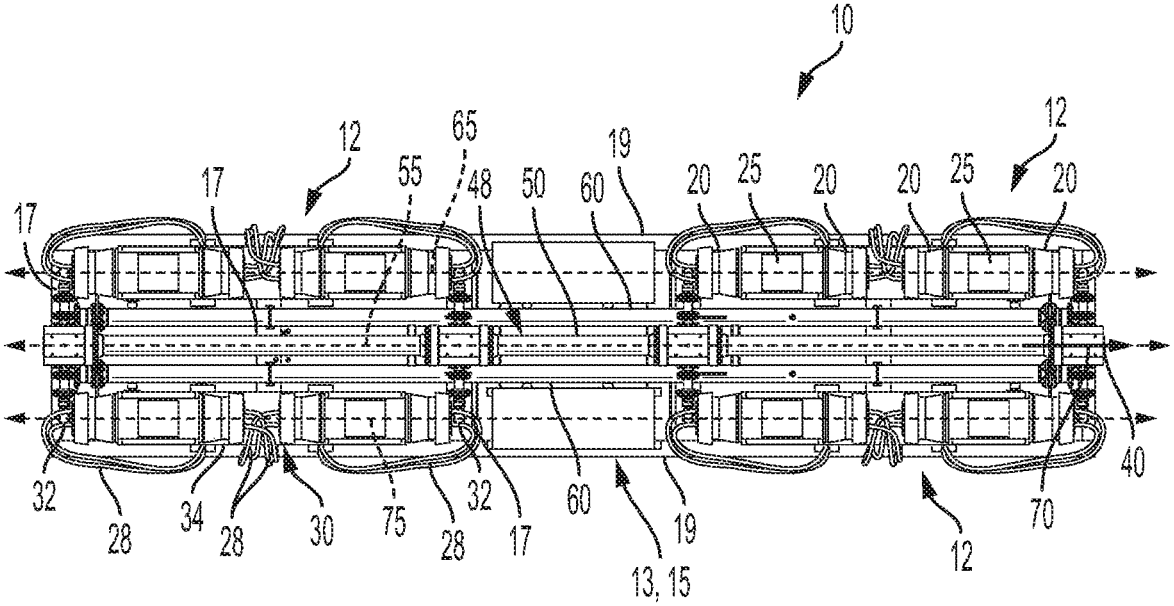
FIG. 1B shows a top view of the integrated pump and manifold assembly of FIG. 1A.
Figure 1C:
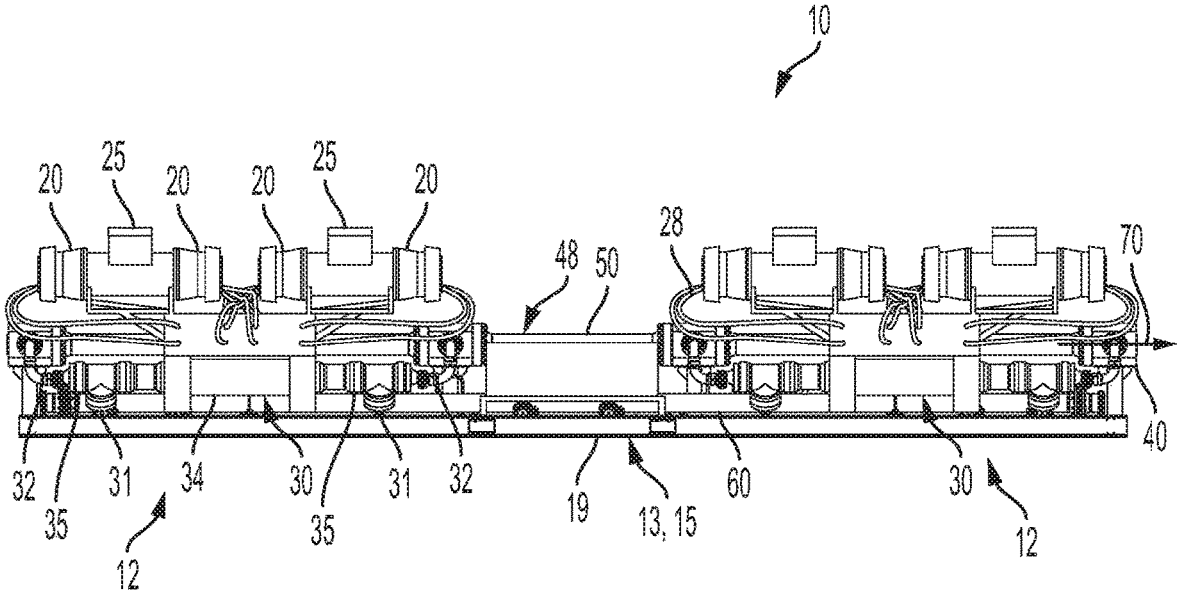
FIG. 1C shows a side view of the integrated pump and manifold assembly of FIG. 1A.
Figure 1D:
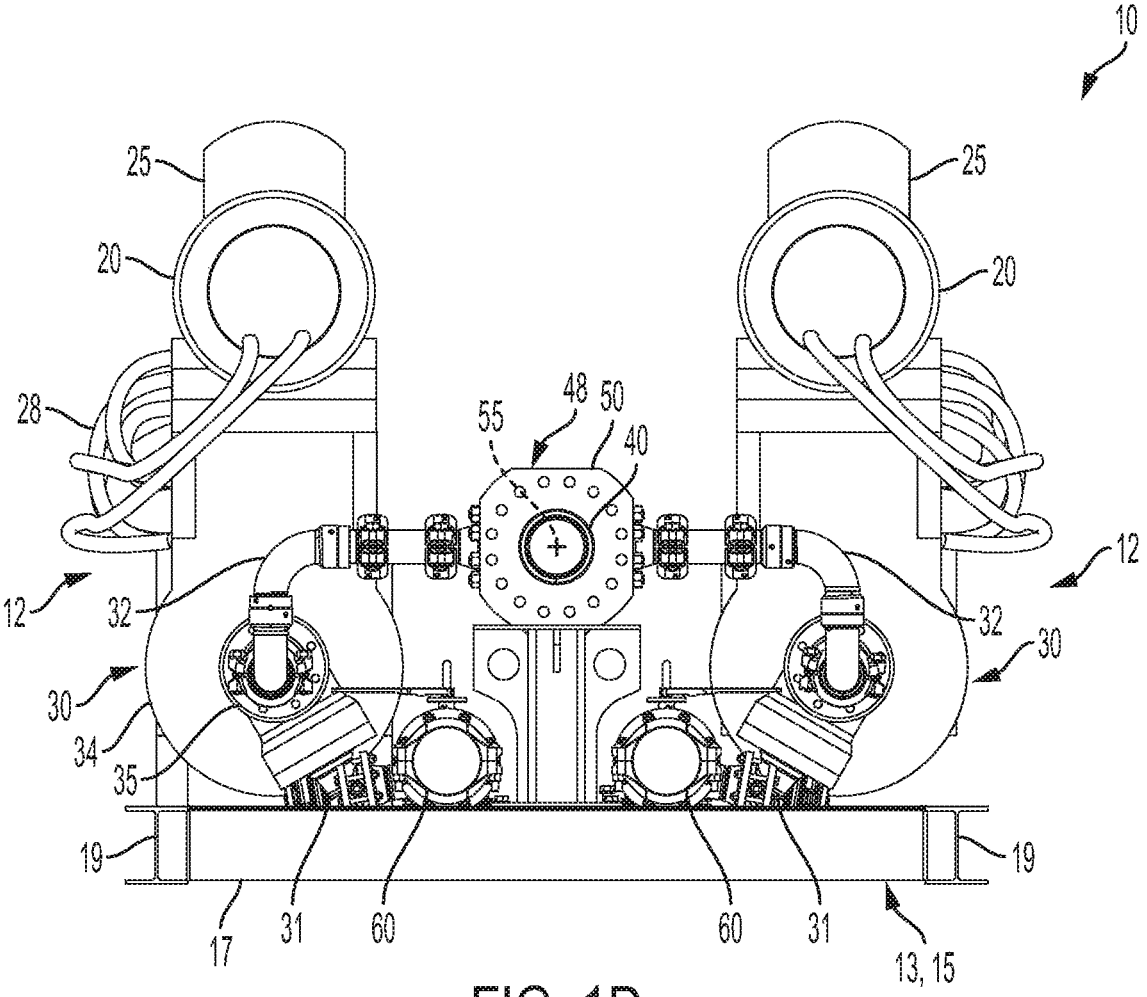
FIG. 1D shows an end view of the integrated pump and manifold assembly of FIG. 1A.
Figure 4:
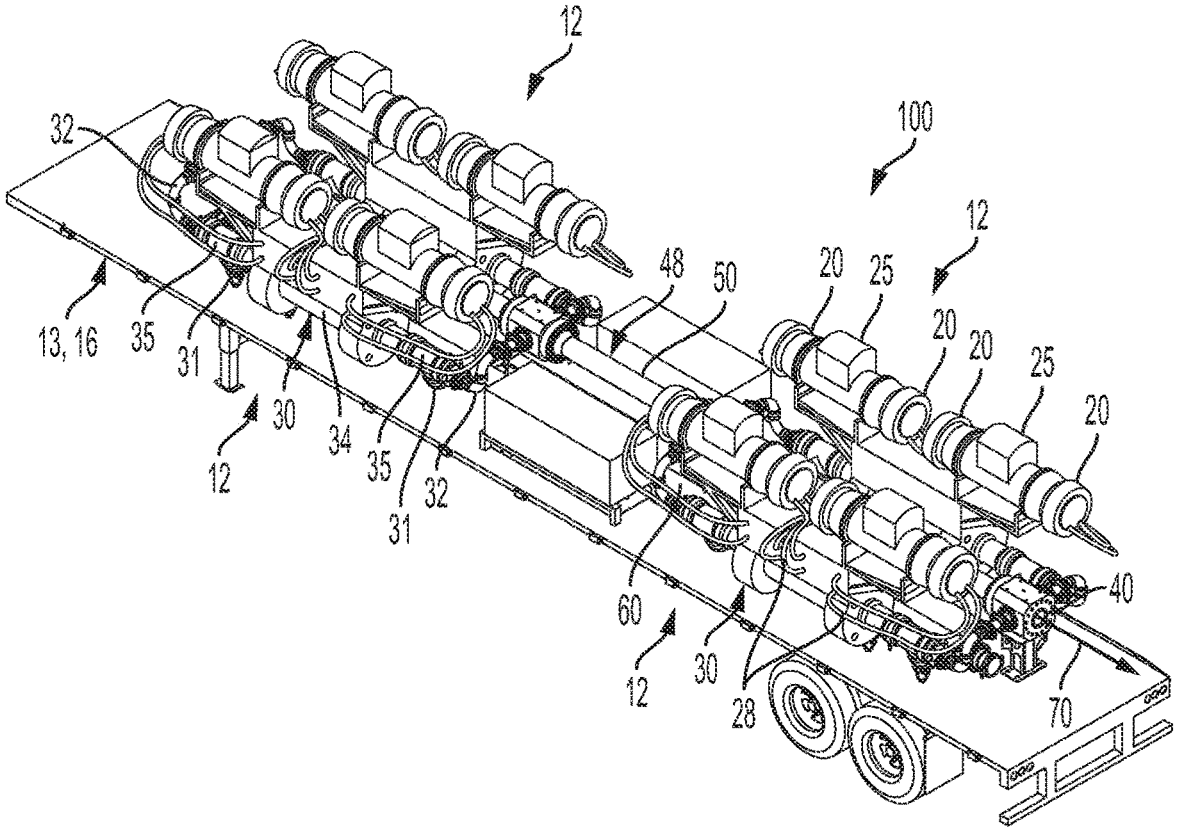
FIG. 4 shows a perspective view of an integrated pump and manifold assembly according to another embodiment.

The support structure 13 may include, for example, a skid 15 (as shown in FIGS. 1A-1D) and/or a trailer 16 (as shown in FIG. 4). As shown in FIG. 1A, the support structure 13 includes longitudinally-extending structural beams or members 19 which are spaced apart from each other and extend parallel to each other. The longitudinally-extending structural members 19 extend along the length of the support structure 13 and substantially parallel to the low pressure line(s) 60 and the high pressure line 50. The support structure 13 additionally includes transversely-extending structural beams or members 17 spaced apart from each other and extend parallel to each other and approximately perpendicular to the longitudinally-extending structural members 19. The transversely-extending structural members 17 extend along the width of the support structure 13 and substantially perpendicular to the low pressure line(s) 60 and the high pressure line 50. Alternatively or additionally, the support structure 13 may include a flat support surface (as shown in FIG. 4). The pump units 12 and the manifold assembly 48 may be mounted, fixed, or attached directly onto the structural members 17, 19 or a support surface of the support structure 13.

In some embodiments, the support structure 13 may include one or both of the skid 15 and the trailer 16. For example, according to various embodiments, the support structure 13 may comprise only one of the skid 15 or the trailer 16. According to another embodiment, the support structure 13 may include both the skid 15 and the trailer 16 such that the skid 15 is mounted on the trailer 16 prior to being moved to the frac site or at the frac site. By mounting the plurality of pump units 12 and the manifold assembly 48 on the support structure 13, the entire pump and manifold assembly 10 can be easily moved around to different locations and frac sites without assembly or disassembly. According to one embodiment, the support structure 13 may be approximately 45 feet long, 8.5 feet wide, and 8 feet tall.

As shown in FIGS. 1A-1D, the integrated pump and manifold assembly 10 includes at least one pump unit 12 (which may be referred to as an "axis"). Preferably, the integrated pump and manifold assembly 10 includes a plurality of pump units 12, such as two, three, four, or more individual axes or pump units 12. However, in various embodiments, more or fewer pump units 12 may be included to accommodate the needs of the frac site. The pump units 12 as shown are all positioned and oriented in the same direction and are parallel to each other (and may be oriented substantially parallel to the low pressure line(s) 60 and the high pressure line 50). Each of the pump units 12 includes an electric motor 25, one or more actuators 20 (e.g., a hydraulic unit or pump), and a frac pump 30. In various embodiments, each of the pump units 12 is, includes, or is part of a linear pump assembly. All of the pump units 12 (in particular the frac pumps 30) receive fluid from and deliver the fluid to a common and single manifold assembly 48.

Figure 5:
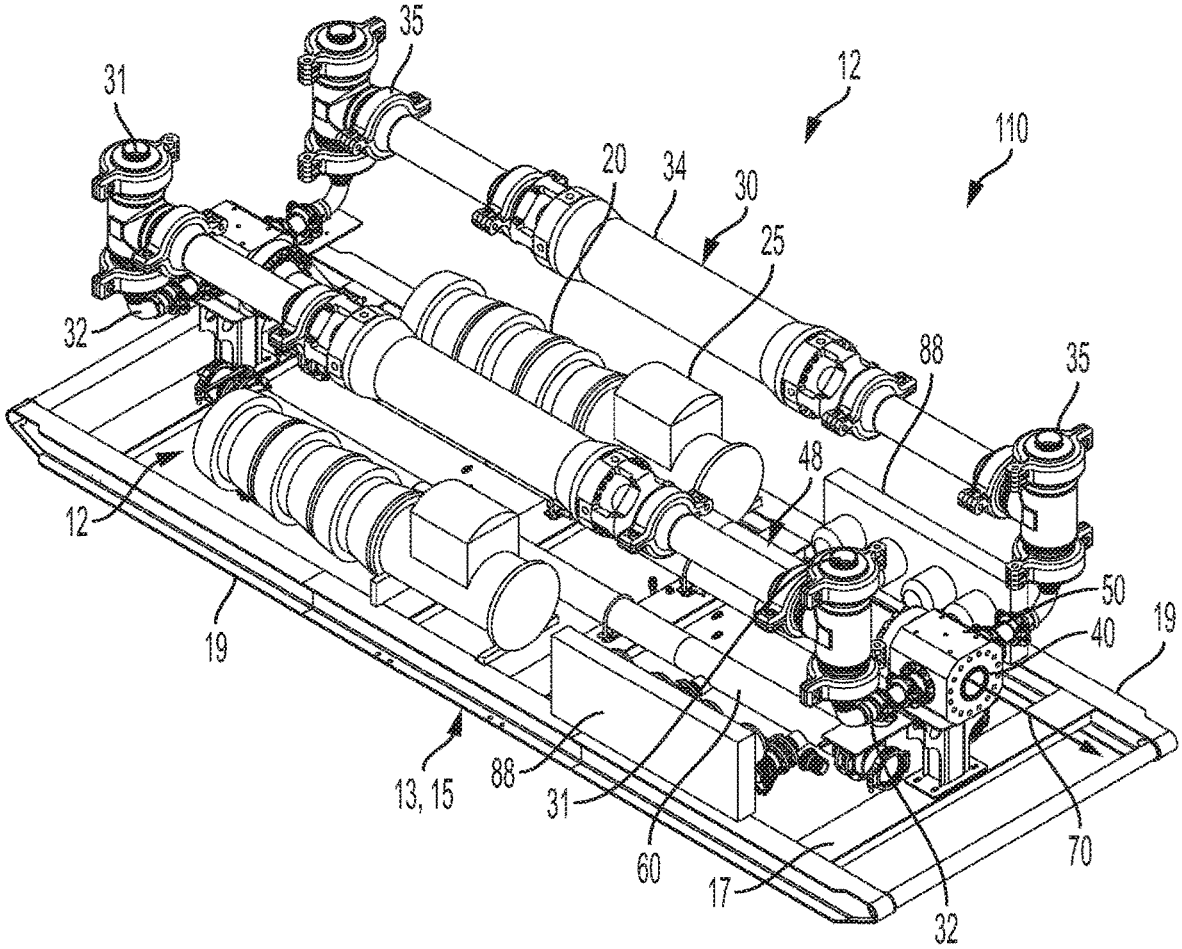
FIG. 5 shows a perspective view of an integrated pump and manifold assembly according to yet another embodiment.

According to some embodiments, the pump units 12 (in particular, the frac pumps 30) may be positioned along opposite sides of the high pressure line 50. Optionally, depending on the number of pump units 12, multiple pump units 12 may be positioned along each side of the high pressure line 50. For example, according to one embodiment as shown in FIG. 1B, two pump units 12 (that are aligned with each other) are positioned along each side of the high pressure line 50. However, according to another embodiment as shown in FIG. 5, only one pump unit 12 is positioned on each side of the high pressure line 50.

Figure 2:
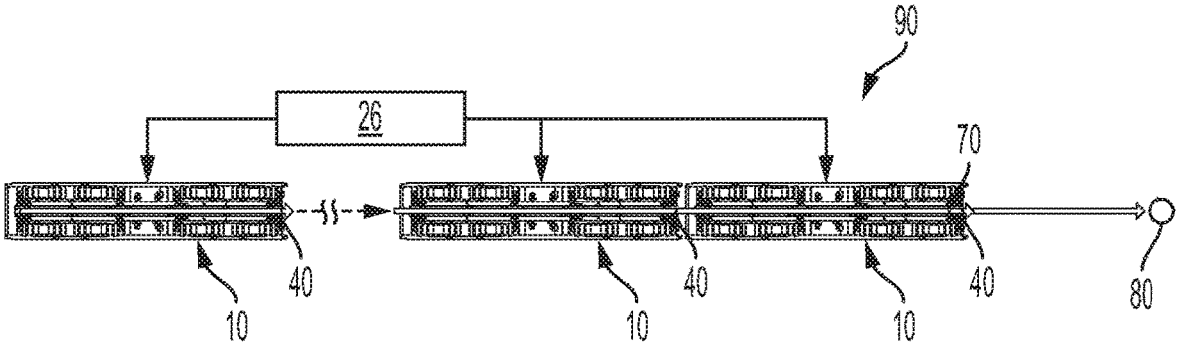
FIG. 2 shows a frac system of a plurality of the integrated pump and manifold assemblies of FIG. 1A attached to each other according to one embodiment.
Figure 3:
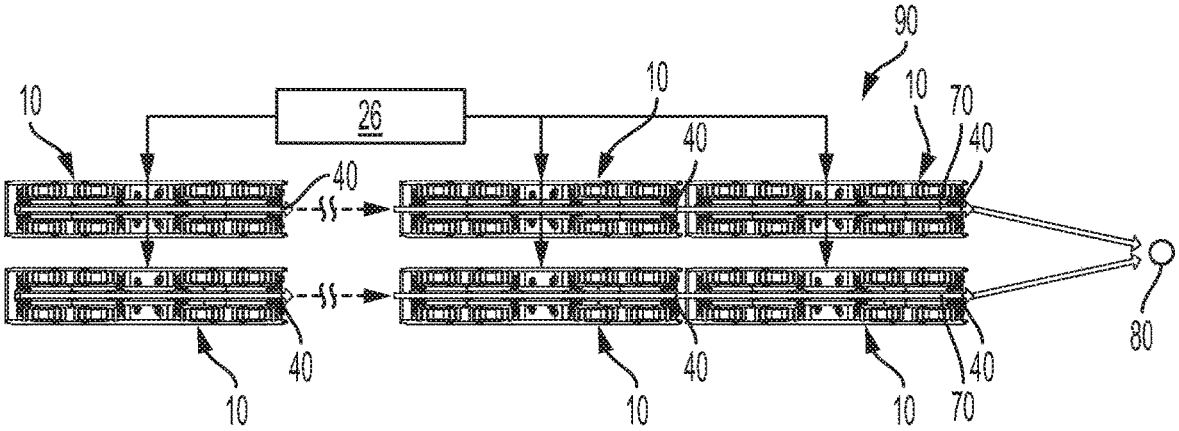
FIG. 3 shows a frac system of a plurality of the integrated pump and manifold assemblies of FIG. 1A attached to each other according to another embodiment.

In operation, the electric motor 25 of the pump unit 12 is configured to electrically power and drive (and provide power to) the actuator 20 (which thus powers and operates the frac pump 30), thereby allowing the pump unit 12 to be used for electric frac ("e-frac"). By using the electric motor 25, the pump and manifold assembly 10 can simply be electrically plugged in to a power source 26 (such as an electrical power source, a primer mover power source, or variable-frequency drive (VFD)) at the fracking site (as shown in FIGS. 2-3), thereby decreasing manual labor (compared to diesel engines). However, according to various other embodiments, the electric motor 25 may be a different type of motor. As shown in FIG. 1A, the pump and manifold assembly 10 (and, in particular, each pump unit 12) may include a plurality of redundant electric motors 25 (rather than a single motor). For example, each of the pump units 12 may include a plurality of (for example, two) electric motors 25 that are aligned along the same axis. Accordingly, the pump and manifold assembly 10 with four pump units 12 may include a total of eight electric motors 25. Although electric motors 25 are referred to herein, other power generators (such as diesel motors or turbine power generators) may alternatively be used to provide electric power. Furthermore, the electric motor 25 may optionally be omitted such that the power source 26 directly powers the actuator 20.

The actuators 20 are configured to drive the frac pumps 30 with hydraulic power or may drive the frac pumps 30 by functioning as a screw drive. According to one embodiment, each of the actuators 20 may be or comprise at least one hydraulic unit or pump that is driven by the electric motor 25 and provide hydraulic power to the frac pump 30 (in particular to the hydraulic cylinder 34 of the frac pump 30). However, the pump units 12 may utilize other ways to drive the linear frac pump 30. The figures depicted herein show just one example of how the actuator 20 can hydraulically drive the linear frac pump 30. However, according to various other embodiments, the actuator 20 may not utilize any hydraulics to drive the frac pumps 30. For example, other ways to drive the linear frac pump 30 can include an electrically driven or powered screw drive that does not utilize any hydraulics. Two actuators 20 may be included with each electric motor 25 and positioned along opposite sides of the electric motor 25. As described further herein, the electric motor 25 and/or the actuators 20 may be integrated with the rest of the pump and manifold assembly 10 (as a part of the pump unit 12) and provided or mounted onto the support structure 13 (as shown in FIGS. 1A-5) or remotely and separately provided from the rest of the pump and manifold assembly (and from the pump unit 12 and the support structure 13) (as shown in FIGS. 6A-8).

According to one embodiment in which the actuators 20 are hydraulic pumps, the actuators 20 use hydraulic fluid (which may be separate from the frac fluid) to drive the frac pump 30. For example, the actuator 20 may be configured to move and drive a plunger or rod within a hydraulic cylinder 34 of the frac pump 30 back and forth to create a pumping action within the frac pump 30, thereby creating suction and discharge at each end of the frac pump 30.

The pump unit 12 may further comprise at least one hydraulic line or hose 28 (preferably a plurality of hydraulic hoses 28) that fluidly connect the actuator 20 to the frac pump 30 (in particular to the hydraulic cylinder 34 of the frac pump 30). Fluid may be pumped from the actuator 20 to the frac pump 30 through the hydraulic hoses 28.

According to some embodiments, the pump units 12 each include a frac pump 30 (which may be referred to as an "axis") that is a linear pump. In particular, the frac pump 30 may be a linear electric actuated pump, rather than a reciprocating frac pump, and may be electrically driven by the electric motor 25 (i.e., e-frac). The frac pump 30 may include a variety of different components and mechanisms that allow the frac pump 30 to operate as a linear pump (rather than a reciprocating pump). For example, each frac pump 30 comprises a hydraulic cylinder 34 and two fluid ends 35. The two fluid ends 35 are positioned along opposite sides of the hydraulic cylinder 34. Depending on the particular configuration, the frac pump 30 may be directly mounted to the support structure 13.

According to one embodiment as shown in FIG. 1B, the pump and manifold assembly 10 comprises four pump units 12. However, the pump and manifold assembly 10 may comprise any number of pump units 12, such as one pump unit 12, two pump units 12 (as shown in FIG. 5, for example), three pump units 12, or more. As shown in the embodiment of FIG. 1B, there are two pump units 12 on each side of a discharge axis 55, each forming a set of pump units 12 that are on the same side of the discharge axis 55. Within each set of two pump units 12 (that are on the same side of the discharge axis 55), the two pump units 12 are positioned and aligned along a mutual pump unit axis. In particular, as shown in FIG. 1B, the two pump units 12 of a first pump unit set on one side of the discharge axis 55 (and the high pressure line 50) are positioned and aligned along a first pump unit axis 65. The two pump units 12 of a second pump unit set on the opposite side of the discharge axis 55 (and the high pressure line 50) are positioned and aligned along a second pump unit axis 75. Each of the first pump unit axis 65 and the second pump unit axis 75 extend longitudinally along the length of the support structure 13. The discharge axis 55, the first pump unit axis 65, and the second pump unit axis 75 are all parallel to each other. In other embodiments, the axes 55, 65, and/or 75 may be askew or not parallel relative to each other. In some embodiments, the low pressure lines 60 are also positioned on and extend along axes parallel to the discharge axis 55, the first pump unit axis 65, and the second pump unit axis 75.

Each of the fluid ends 35 of the frac pump 30 comprises a suction side or portion with a fluid end input or inlet 31 (which may be referred to as a frac pump inlet) and a high pressure or discharge side or portion with a fluid end output or outlet (which may be referred to as a frac pump outlet), where the fluid end outlet comprises a fluid end discharge iron or line 32. The fluid end discharge line 32 is configured to fluidly couple the frac pump 30 to the high pressure line 50. Accordingly, high pressure fluid can flow from the frac pump 30 to the high pressure line 50 through the fluid end discharge line 32.

Each of the one or more low pressure lines 60 are fluidly coupled to (and in fluid communication with) the fluid end inlets 31 of each of the fluid ends 35 of each frac pump 30. Accordingly, incoming low pressure fluid is drawn into the frac pump 30 of the pump unit 12 from one of the low pressure lines 60 through the fluid end inlet 31, and the frac pump 30 is configured to receive the low pressure fluid from the low pressure line 60 through the fluid end inlet 31.

The main line or high pressure discharge line 50 is fluidly coupled to (and in fluid communication with) one of the fluid end outlets (specifically to the fluid end discharge line 32) of each of the fluid ends 35 of each frac pump 30. Accordingly, outgoing pressurized or high pressure fluid is discharged from the frac pump 30 of the pump unit 12 through the fluid end outlet (through the fluid end discharge line 32) to the high pressure line 50, and the frac pump 30 is configured to output the high pressure fluid to the high pressure line 50 through the fluid end outlet (i.e., the fluid end discharge line 32).

According to one embodiment, the hydraulic cylinder 34 defines an internal area or pump fluid chamber. The hydraulic cylinder 34 comprises an internal plunger or rod that is positioned within the internal fluid chamber of the hydraulic cylinder 34. The internal rod moves linearly back and forth along the length of the internal fluid chamber within the hydraulic cylinder 34 as fluid flows into and out from the frac pump 30 through the fluid ends 35. The hydraulic cylinder 34 of the frac pump 30 is configured to pressurize the incoming fluid from one of the fluid ends 35 and discharge the fluid through the other fluid end 35 as the plunger moves within the hydraulic cylinder 34.

In operation, low pressure fluid is drawn from a fluid source into the low pressure lines 60. The fluid is fed into the internal chamber of the hydraulic cylinder 34 of the frac pump 30 of each pump unit 12 (through the fluid end inlet 31 of one of the fluid ends 35) from the low pressure lines 60, where the fluid is pressurized. The fluid flows through the internal chamber of the hydraulic cylinder 34 of the frac pump 30 to the other fluid end 35 and flows out from the frac pump 30 of the pump unit 12 through the fluid end discharge line 32 to the high pressure discharge line 50. The resulting high pressure fluid 70 is discharged from the high pressure discharge line 50 (and the entire pump and manifold assembly 10) through the high pressure discharge outlet 40 and subsequently flows to the wellhead 80 (or to another pump and manifold assembly 10 and eventually to the wellhead 80), as shown in FIGS. 2-3.

The frac pump 30 may include a variety of different components and mechanisms to pump fluid. According to one embodiment, in operation, the fracturing fluid (that flows from the low pressure line(s) 60 via each of the fluid ends 35 of the frac pump 30) is caused to flow into and out of the pump fluid chamber of the hydraulic cylinder 34 of the frac pump 30 as a consequence of the reciprocation of the internal, piston-like rod moving or shuttling back and forth within the fluid chamber to change the hydraulic pressure. As the plunger moves away from a first fluid end 35 and toward a second fluid end 35 within the fluid chamber, the fluid is drawn into the fluid chamber (from the low pressure line 60) through the fluid end inlet 31 of the first fluid end 35 and pushed out from the fluid chamber through the fluid end outlet (i.e., the fluid end discharge line 32) of the second fluid end 35 (to the high pressure line 50). After a full stroke, the rod then reverses direction within the fluid chamber (moving from the second fluid end 35 and toward the first fluid end 35 within the fluid chamber). Accordingly, the fluid is instead drawn into the fluid chamber (from the low pressure line 60) through the fluid end inlet 31 of the second fluid end 35 and pushed out from the fluid chamber through the fluid end outlet (i.e., the fluid end discharge line 32) of the first fluid end 35 (to the high pressure line 50). Each of the fluid ends 35 may include various valves to control the movement of fluid through the fluid ends 35 and that are responsive to the differential pressures within the fluid chamber.

By integrating the pump units 12, the manifold assembly 48, and the support structure 13 together as one fixed unit, the entire pump and manifold assembly 10 can be transported and delivered to the frac site in an assembled manner, thereby reducing the amount of space that the pump and manifold assembly 10 take up at the frac site and the amount of labor, assembly, and additional parts that would otherwise be needed to assemble the pump and manifold assembly 10 at the frac site. According to one embodiment as shown in FIGS. 2-3, since the electric motor 25 and the actuator 20 are positioned on and integrated with the rest of the pump and manifold assembly 10 (e.g., mounted onto the support structure 13) and the frac pumps 30 of the pump units 12 are already fluidly attached to the manifold assembly 48, once the pump and manifold assembly 10 arrives to the frac site, the pump and manifold assembly 10 only needs to be connected to (e.g., plugged into) the power source 26 and fluidly connected to the wellhead 80 to complete the setup of the pump and manifold assembly 10. Accordingly, once the pump and manifold assembly 10 arrives to the frac site, the pump units 12 do not need to be fluidly connected to the manifold assembly 48 (since the pump units 12 are already fluidly connected to the manifold assembly 48 prior to transit to the frac site).

By using frac pumps 30 that are linear pumps (instead of reciprocating pumps), the frac pumps 30 (even a plurality of frac pumps 30) can easily fit on the support structure 13 with the manifold assembly 48 due to the shape and size of the linear pumps. Furthermore, by utilizing electric power, the linear pumps can be more easily and efficiently be used.

As shown in FIGS. 2-3, a plurality of pump and manifold assemblies 10 may be fluidly attached to each other to create a frac system 90. The plurality of pump and manifold assemblies 10 of the frac system 90 are arranged end-to-end at the frac site to deliver fluid to a single wellhead 80. For example, two, three, or more pump and manifold assemblies 10 may be attached directly to each other in series in one line, all of which deliver fluid to the same wellhead 80. As shown in FIG. 2, the frac system 90 comprises a single line (with a plurality of pump and manifold assemblies 10) that deliver fluid to a single wellhead 80. Alternatively, as shown in FIG. 3, the frac system 90 comprises multiple lines of pump and manifold assemblies 10 (that each include a plurality of pump and manifold assemblies 10 that are positioned in series with each other) that are arranged in parallel with each other, where all of the lines of pump and manifold assemblies 10 concurrently deliver fluid to the same wellhead 80. The fluid from each of the lines of pump and manifold assemblies may fluidly combine with each other prior to or at the wellhead 80. The various other embodiments of the pump and manifold assembly may also be arranged in similar manners, as shown, for example, in FIGS. 7-8. Alternatively, a single pump and manifold assembly 10 may lead to a single wellhead 80.

The embodiment of the pump and manifold assembly 10 shown in FIGS. 1A-3 provides pump units 12 that have frac pumps 30 with a relatively shorter stroke. Accordingly, two pump units 12 are positioned along both the length and width of the pump and manifold assembly 10 (for a total of four pump units 12). However, the pump and manifold assembly 10 may have any number of pump units 12. The pump and manifold assembly 10 can be remotely attached or mounted to the power source 26 (such as a VFD) when at the frac site, as shown in FIGS. 2-3. Furthermore, the pump units 12 and the manifold assembly 48 are mounted to a support structure 13 that is a skid 15. However, the pump and manifold assembly 10 may have certain modifications according to the desired use.

For example, FIG. 4 shows another embodiment of a pump and manifold assembly 100 in which the pump units 12 and the manifold assembly 48 are mounted to a support structure 13 that is a trailer 16. The pump and manifold assemblies 100, 110 (as shown in FIGS. 4 and 5, respectively) can also be remotely attached or mounted to the power source 26 (such as an electric power supply or VFD) when at the frac site (without having to attach the pump units 12 to the manifold assembly 48), as described further herein.

Figure 6A:
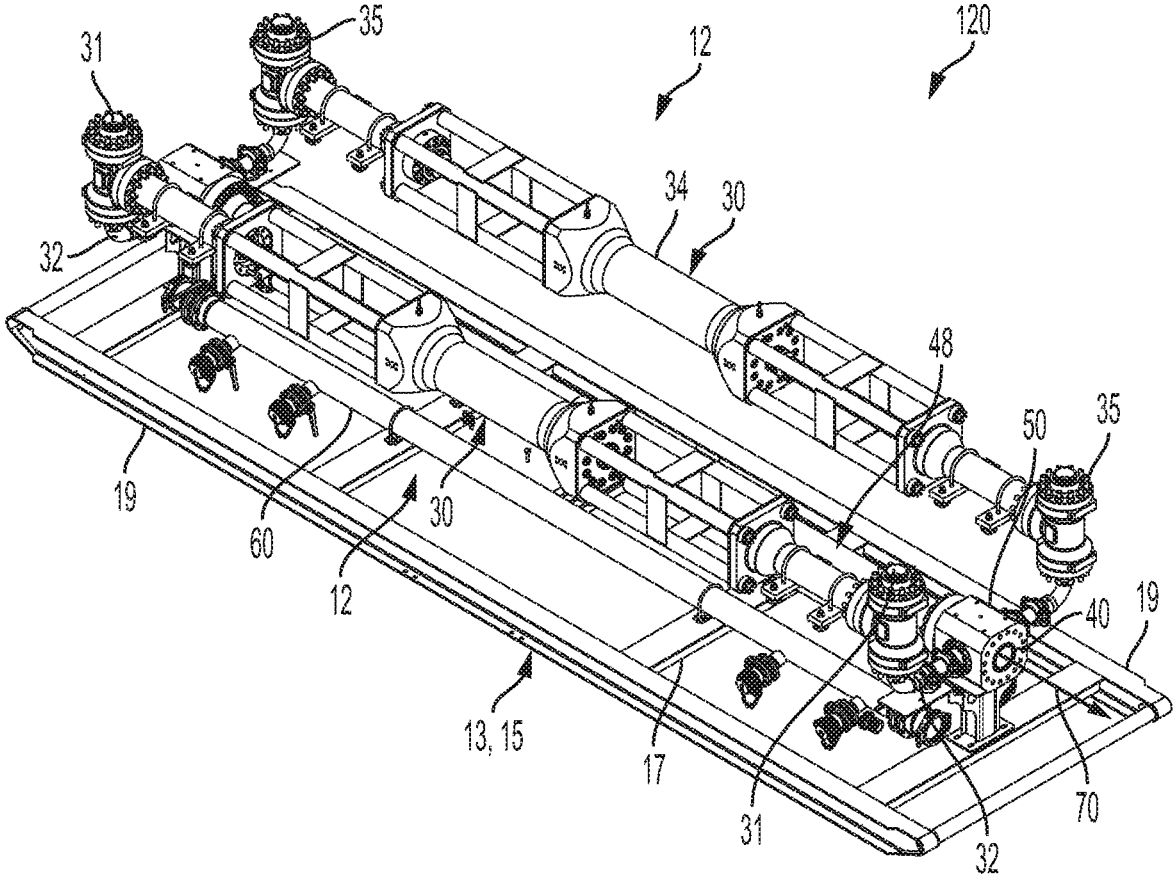
FIG. 6A shows a perspective view of an integrated pump and manifold assembly according to still another embodiment.
Figure 6B:
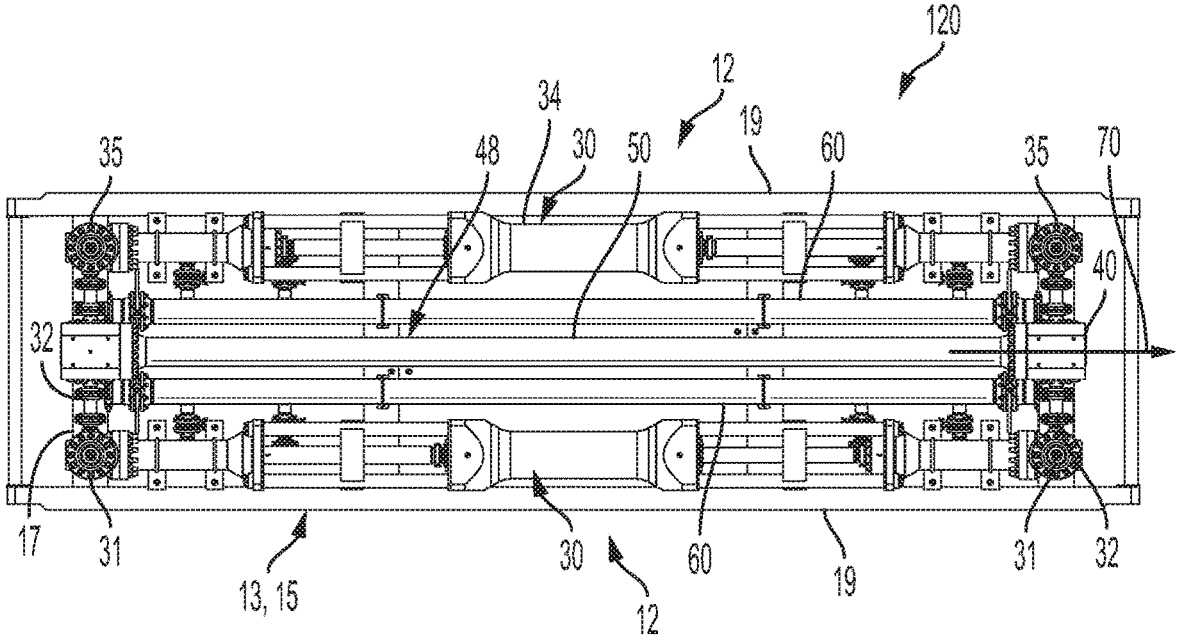
FIG. 6B shows a top view of the integrated pump and manifold assembly of FIG. 6A.
Figure 6C:
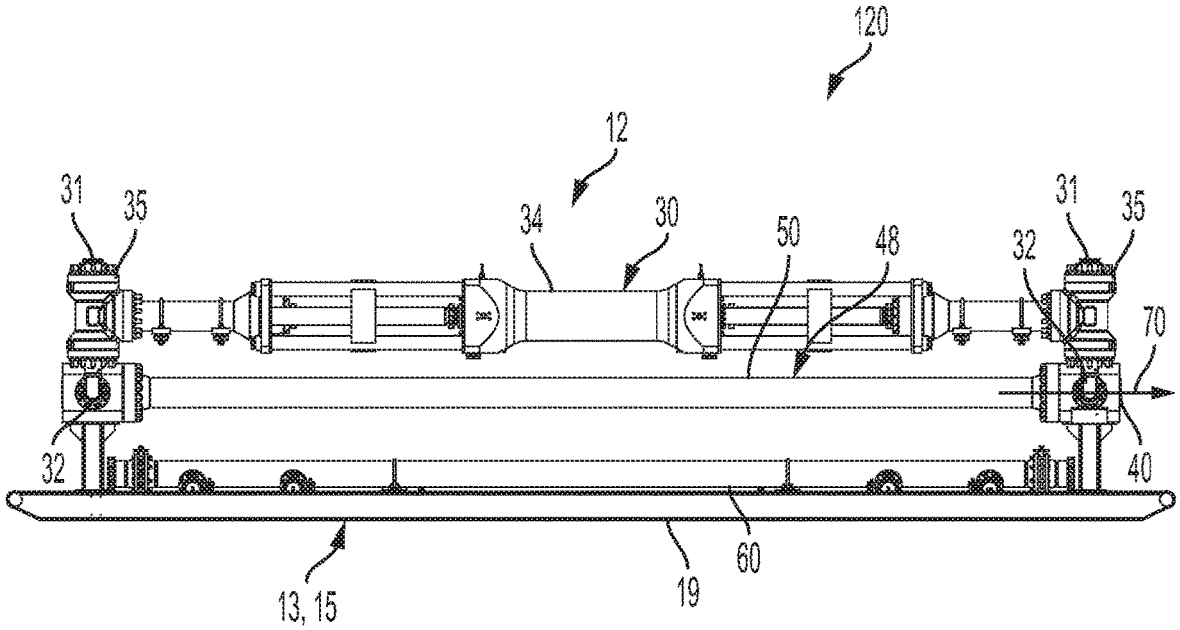
FIG. 6C shows a side view of the integrated pump and manifold assembly of FIG. 6A.
Figure 6D:
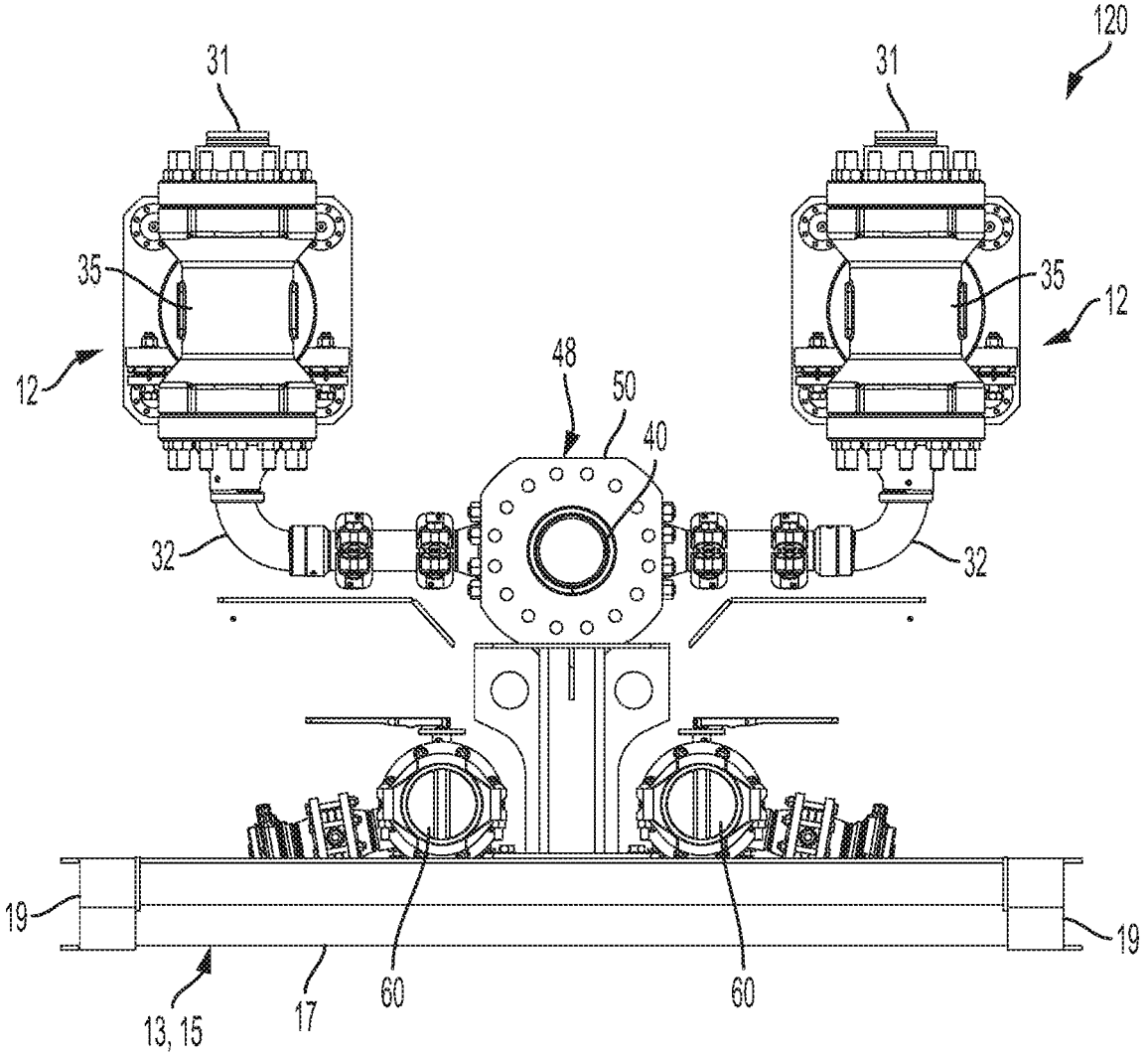
FIG. 6D shows an end view of the integrated pump and manifold assembly of FIG. 6A.

FIGS. 5 and 6A show various embodiments of a pump and manifold assembly 110 and 120, respectively, that each provide pump units 12 that have a relatively longer stroke. For example, instead of having a total of four pump units 12, the pump and manifold assemblies 110, 120 each comprise a total of two pump units 12, with one pump unit 12 on each side of a single high pressure line 50 (such that the pump and manifold assemblies 110, 120 each have two pump units 12 along their width and one pump unit 12 along their length, for a total of two pump units 12). However, the pump and manifold assemblies 110, 120 may each have any number of pump units 12, such as one, three, or more pump units 12. The frac pump 30 of each of the pump units 12 of the pump and manifold assemblies 110, 120 have a relatively longer stroke and may be or comprise a common rod (as shown in FIG. 5) or a pony rod (as shown in FIG. 6A).

Figure 7:
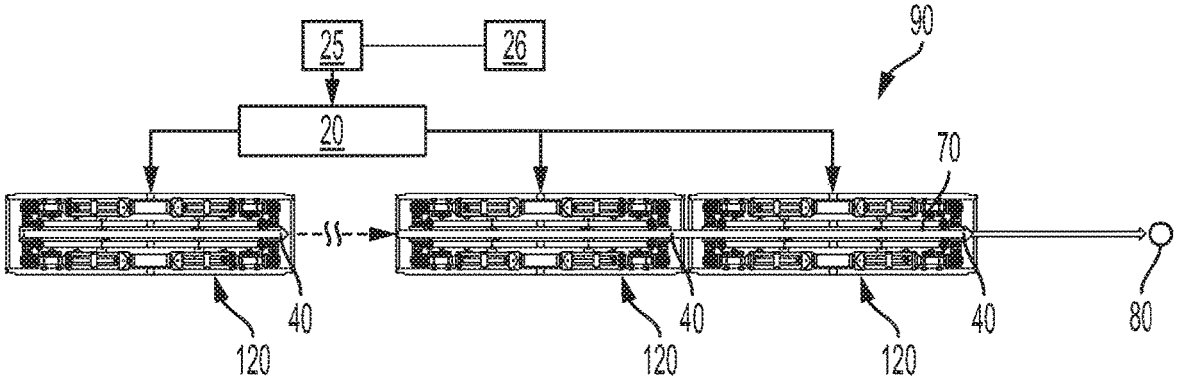
FIG. 7 shows a frac system of a plurality of the integrated pump and manifold assemblies of FIG. 6A attached to each other according to one embodiment.
Figure 8:
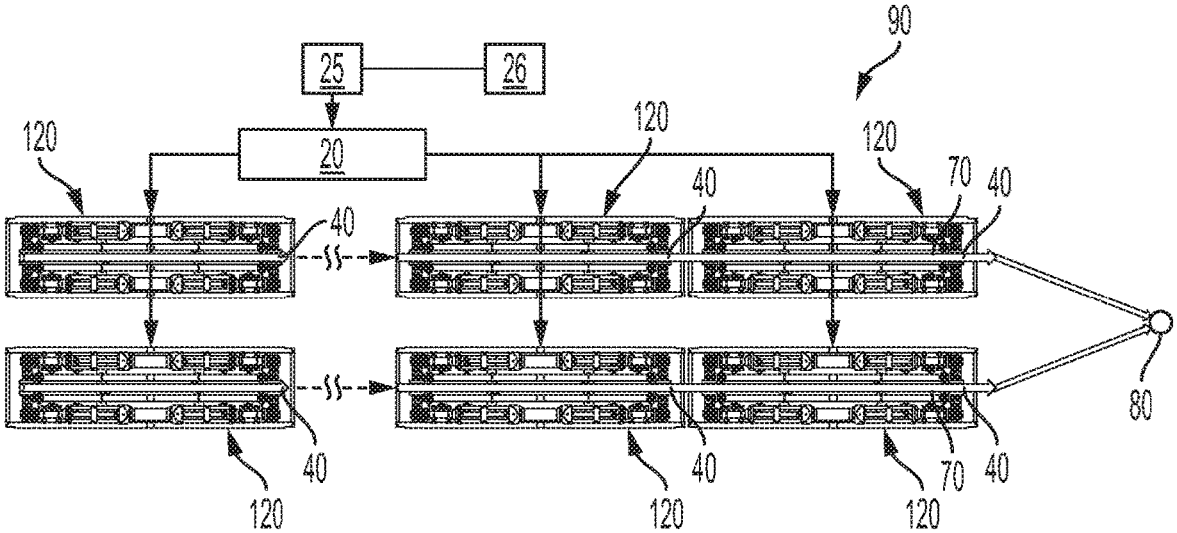
FIG. 8 shows a frac system of a plurality of the integrated pump and manifold assemblies of FIG. 6A attached to each other according to another embodiment.

Additionally, as shown with the pump and manifold assembly 120 of FIGS. 6A-8, the actuator 20 and the electric motor 25 may be provided separately from the rest of the pump unit 12 (in particular the frac pump 30) and the rest of the pump and manifold assembly 120. Accordingly, the hydraulic power supply from the actuator 20 may be remotely provided and are not mounted onto the support structure 13. Instead, the actuator 20 and the electric motor 25 may be positioned on a separate skid or support structure and separately attachable to the rest of the pump unit 12 once the pump and manifold assembly 120 arrives at the frac site. The frac pump(s) 30 and the manifold assembly 48 are still provided with, integrated with, and mounted on the support structure 13. In this arrangement, as shown in FIGS. 7-8, only the hydraulic fluid is needed to be supplied to the pump and manifold assembly 10 to drive the frac pump 30 (and the power source 26 does not need to be separately attached to the frac pump 30 since the power source 26 is already attached to the actuator 20 (optionally via the electric motor 25)). Furthermore, the pump and manifold assembly 120 may not include any coolers.

It is noted that the various embodiments disclosed herein may have other components, such as cooling devices, inlet or suction connections, and/or outlet or discharge connections, which have been omitted for clarity and understanding. For example, any of the integrated pump and manifold assemblies 10, 100, 110, 120 may also include coolers to regulate the temperature of the components thereof. One example of coolers is shown in FIG. 5, in which two oil coolers 88 are positioned along opposite sides of the pump and manifold assembly 110. However, the various pump and manifold assemblies disclosed herein may include any number and arrangement of coolers 88. Furthermore, the coolers 88 may optionally be separately and remotely provided from the rest of the pump and manifold assembly.

The integrated pump and manifold assemblies 10, 100, 110, 120 shown in the figures and described herein allows for at least one pump unit 12 (preferably multiple separate pump units 12) to be mounted on a single support structure 13. In particular since the pump and manifold assemblies 10, 100, 110, 120 are modular in nature, more or fewer pump units 12 may be included in or integrated on a single support structure 13 than are shown in the figures. The integration of the pump units 12 and the manifold assembly 48 allow for this compact positioning of components on a single support structure 13. As described above, the embodiments described herein allow for an overall improvement in efficiency, cost savings, space savings, environmental impact, and safety considerations at a frac site.

The various embodiments disclosed herein show only some of many configurations. The various pump and manifold assemblies may have different numbers and arrangements of components, including but not limited to the number and arrangement of the pump units 12, the actuators 20, the electric motors 25, the frac pumps 30, the high pressure lines 50, and the low pressure lines 60 on the single support structure 13. According to one embodiment, the integrated pump and manifold assembly 10 includes four pump units 12 (which include a total of four frac pumps 30), eight electric motors 25, and sixteen actuators 20. However, the various pump and manifold assemblies disclosed herein may have any number of these components. Furthermore, the number of discharge lines and suction lines could vary depending on the application. According to various embodiments, the support structure 13 may be a skid 15 or a trailer 16, the actuator 20 and/or the electric motor 25 may be included with or separate (or remote) from the rest of the pump unit 12 (in particular the frac pump 30) and the rest of the pump and manifold assembly. In addition, the number and location of pump units, which may affect the configuration of the suction and discharge connections, could vary depending on the application. The various pump and manifold assemblies may include pump units that are double-acting linear pumps (that pump from both ends) or single-acting pumps (that pump from one end only).

Each of the various pump and manifold assemblies 10, 100, 110, 120 may include any of the various features, configurations, mechanisms, and/or components of the other pump and manifold assemblies, unless otherwise noted herein.

It should be noted that any use of the term "example" herein to describe various embodiments is intended to indicate that such embodiments are possible examples, representations, and/or illustrations of possible embodiments (and such term is not intended to connote that such embodiments are necessarily extraordinary or superlative examples).

As utilized herein, the term "substantially" and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed (e.g., within plus or minus five percent of a given angle or other value) are considered to be within the scope of the invention as recited in the appended claims. The term "approximately" when used with respect to values means plus or minus five percent of the associated value.

The terms "coupled" and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the figures. It should be noted that the orientation of various elements may differ according to other example embodiments, and that such variations are intended to be encompassed by the present disclosure.

It is important to note that the construction and arrangement of the various example embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Additionally, features from particular embodiments may be combined with features from other embodiments as would be understood by one of ordinary skill in the art. Other substitutions, modifications, changes and omissions may also be made in the design, operating conditions and arrangement of the various example embodiments without departing from the scope of the present invention.

What is claimed is:

1. An integrated pump and manifold assembly comprising:

a support structure;

a manifold assembly mounted on the support structure and comprising:

one or more low pressure lines extending substantially the entire length of the support structure; and a high pressure discharge line extending substantially the entire length of the support structure and comprising a discharge outlet configured to fluidly couple to a wellhead; and one or more frac pumps each mounted on the support structure and comprising a frac pump inlet and a frac pump outlet, wherein one of the one or more frac pumps is mounted on an opposite side of the high pressure discharge line from another of the one or more frac pumps, wherein the one or more frac pumps are configured to be in fluid communication with the one or more low pressure lines and to receive a low pressure fluid from the one or more low pressure lines through the frac pump inlet of each of the one or more frac pumps, wherein the one or more frac pumps are configured to be in fluid communication with the high pressure discharge line and to output a high pressure fluid to the high pressure discharge line through the frac pump outlet of each of the one or more frac pumps, and wherein the one or more low pressure lines, the high pressure discharge line, and the one or more frac pumps are integrated as a single unit and mounted on the support structure.

2. The integrated pump and manifold assembly of claim 1, further comprising at least one actuator configured to control the one or more frac pumps.

3. The integrated pump and manifold assembly of claim 2, wherein the at least one actuator is one of a hydraulic pump or an electrically-powered screw drive.

4. The integrated pump and manifold assembly of claim 2, wherein the at least one actuator is integrated with the one or more frac pumps as part of a pump unit.

5. The integrated pump and manifold assembly of claim 2, further comprising at least one electric motor configured to drive the at least one actuator.

6. The integrated pump and manifold assembly of claim 5, wherein the at least one electric motor and/or the at least one actuator are mounted on the support structure and integrated with the one or more low pressure lines, the high pressure discharge line, and the one or more frac pumps as a single unit.

7. The integrated pump and manifold assembly of claim 5, wherein the at least one electric motor and/or the at least one actuator are remotely provided and separate from the support structure.

8. The integrated pump and manifold assembly of claim 5, further comprising a pump unit that comprises the at least one electric motor, the at least one actuator, and the one or more frac pumps, wherein the pump unit produces a pumping power of up to 12,000 hydraulic horsepower.

9. The integrated pump and manifold assembly of claim 5, further comprising a pump unit that comprises the at least one electric motor, the at least one actuator, and the one or more frac pumps, wherein the pump unit is capable of producing a discharge pressure of up to 15,000 pounds per square inch.

10. The integrated pump and manifold assembly of claim 2, further comprising a plurality of pump units each comprising at least one of the one or more frac pumps and the at least one actuator, wherein at least a portion of the plurality of pump units are positioned and aligned along a pump unit axis, wherein the high pressure discharge line is positioned along a discharge axis that is parallel to the pump unit axis.

11. The integrated pump and manifold assembly of claim 10, wherein the plurality of pump units comprises four pump units, wherein two of the four pump units are positioned on one side of the discharge axis and two others of the four pump units are positioned on an opposite side of the discharge axis.

12. The integrated pump and manifold assembly of claim 1, wherein the one or more low pressure lines comprise two low pressure lines.

13. The integrated pump and manifold assembly of claim 12, wherein the high pressure discharge line is positioned along a discharge axis and parallel to the two low pressure lines.

14. The integrated pump and manifold assembly of claim 13, wherein the one or more frac pumps comprise two frac pumps, wherein one of the two low pressure lines and one of the two frac pumps are positioned on one side of the discharge axis and a second of the two low pressure lines and a second of the two frac pumps are positioned on an opposite side of the discharge axis.

15. The integrated pump and manifold assembly of claim 1, wherein the support structure comprises one of a skid or a trailer.

16. The integrated pump and manifold assembly of claim 1, wherein the one or more frac pumps are linear pumps.

17. The integrated pump and manifold assembly of claim 1, wherein the frac pump outlet of each of the one or more frac pumps comprises a discharge line configured to fluidly couple each of the one or more frac pumps to the high pressure discharge line.

18. The integrated pump and manifold assembly of claim 1, wherein the one or more frac pumps comprises one of a common rod or a pony rod.

19. A method of assembling an integrated pump and manifold assembly comprising:

providing a support structure;

mounting a manifold assembly on the support structure, the manifold assembly comprising:

one or more low pressure lines extending substantially the entire length of the support structure; and a high pressure discharge line extending substantially the entire length of the support structure, the high pressure discharge line comprising a discharge outlet configured to fluidly couple to a wellhead;

mounting one or more frac pumps on the support structure, wherein one of the one or more frac pumps is mounted on an opposite side of the high pressure discharge line from another of the one or more frac pumps, the one or more frac pumps each comprising a frac pump inlet and a frac pump outlet;

fluidly connecting the one or more frac pumps and the one or more low pressure lines such that the one or more frac pumps are configured to receive a low pressure fluid from the one or more low pressure lines through the frac pump inlet of each of the one or more frac pumps; and fluidly connecting the one or more frac pumps and the high pressure discharge line such that the one or more frac pumps are configured to output a high pressure fluid to the high pressure discharge line through the frac pump outlet of each of the one or more frac pumps, wherein the one or more low pressure lines, the high pressure discharge line, and the one or more frac pumps are integrated as a single unit and mounted on the support structure.

* * * * *